US005313894A

United States Patent [19]

Ishikawa

[11] Patent Number: 5,313,894

[45] Date of Patent: May 24, 1994

[54] STRUCTURE OF INCINERATOR PLANT

[75] Inventor: Shiro Ishikawa, Kiryu, Japan

[73] Assignee: Kankyouhozen Kotobuki-Seisakusyo Co., Ltd., Gunma, Japan

[21] Appl. No.: 981,120

[22] Filed: Nov. 24, 1992

[30] Foreign Application Priority Data

Jul. 23, 1991 [JP] Japan ..... 3-057499[U]
Mar. 13, 1992 [JP] Japan ..... 4-012677[U]
May 12, 1992 [JP] Japan ..... 4-031037[U]

[51] Int. Cl.[5] ..... B09B 3/00

[52] U.S. Cl. ..... 110/235; 110/229; 110/210; 110/211

[58] Field of Search ..... 110/235, 229, 210, 211, 110/233; 126/152 B; 422/143; 122/371, 374

[56] References Cited

U.S. PATENT DOCUMENTS 1,348,235 8/1920 Morris ..... 122/371
4,913,069 4/1990 Schultz et al. ..... 110/211 X
5,101,739 4/1992 Nance et al. ..... 110/229

*Primary Examiner*—Edward G. Favors
*Attorney, Agent, or Firm*—Townsend & Banta

[57] ABSTRACT

An incinerator plant is provided having a primary and secondary incinerator and a combustion furnace connected thereof, the incinerators having a cooling chamber filled with cooling water which is formed between the bottom plate and a partition wall plate, with the combustion chamber formed above the bottom plate. A fan chamber is formed under the partition wall plate and connected to the combustion chamber by a draft tube installed through the bottom plate and partition wall plate so that outside air fed in to the fan chamber flows in to the combustion through the draft tubes, and the bottom plate which has become hot will be cooled by cooling water in the cooling chamber. Gases produced from the incinerator are passed into the combustion chamber which is adapted to burn combustion gases generated in the primary and secondary incinerators.

4 Claims, 8 Drawing Sheets

STRUCTURE OF INCINERATOR PLANT

BACKGROUND OF THE INVENTION

1. Field of the Invention

The present invention relates to the structure of an incinerator plant for incineration of wastes such as waste tires, and more particularly, to improvements in the structure of an incinerator plant which is capable of controlling discharge of black smoke gases to the utmost, and improving convenience of use, and furthermore protecting the incinerator plant from combustion heat.

2. Description of the Prior Art

Great developments in recent years in industry and economics have brought about a tremendous growth in demands for automobiles, such as passenger cars, trucks, etc., being accompanied by an ever increasing volume of waste tires of these automobiles, and consequently presenting a serious social problem as in the case of a growing amount of other kinds of wastes and refuses.

Waste tires now increasing are brought chiefly to a specific waste disposal yard where they will be incinerated. Incineration of waste tires, however, produces excessive quantities of black smoke, making it very difficult to perform waste tire incineration. In addition, there are vicious waste disposal and treatment contractors will illegally discharge waste tires in forests, which is also presenting a serious environmental problem.

To solve these problems, there have been developed various kinds of incinerators now in practical use.

For example, there is known an incinerator plant of such a design that waste tires are burned in a fully enclosed incinerator furnace by supplying the outside air into the furnace, and at the same time gases of black smoke and other gases produced in the course of tire incineration are brought out into a chamber where water is sprayed from above or from the side in an attempt to carry dusts and other particles contained in the gases away in the sprayed water.

Also known is an incinerator plant as shown in FIG. 8, that is constituted by connecting, through a passageway 3, an incinerator 1 of a cylindrical form to a combustion furnace 2 of a cylindrical form and having a stack 5 erected on the top thereof. In the incinerator 1, waste tires are burned while gases generated in the combustion process are blown into the combustion furnace 2 by means of a fan 7, being burned completely within this combustion furnace 2.

Furthermore, there has been known such an incinerator plant (FIG. 9) that incinerators 1' and 1'' of a cylindrical form and a combustion furnace 2' of a cylindrical form and having a stack 5' erected on the top thereof are arranged in a nearly triangular form; the incinerator 1' and the combustion furnace 2' are connected by a passageway 3', and the incinerator 1'' and the combustion furnace 2' are connected by a passageway 3''; and furthermore doors 7', 8' and 9' for discharging unburned substances and ash are arranged in three places in the sides of the incinerators 1' and 1'' and the combustion furnace 2'.

In the passageways 3' and 3'' is inserted a duct, which is not illustrated, in a direction toward the combustion furnace 23', to send gases produced in the incinerators 1' and 1'' into the combustion furnace 2' by the outside air drawn in through the duct. The gases are ignited at the outlet of the passageways 3' and 3'' for burning the gases in the combustion furnace 2'.

In the bottom of each of the incinerators 1, 1' and 1'' is installed a bottom plate provided with a plurality of air vent holes. In the fan chamber formed under the bottom plate is installed a duct 6 (not illustrated in FIG. 9) for supplying the outside air as shown in FIG. 8. The outside air thus supplied is blown upward through the air vent holes to promote the combustion of wastes.

Problems the Invention Solves

The above-described conventional structure of an incinerator plant, however, has the following problem.

In the incinerator plant of such a design that gases occurring therein flow through a water spray chamber, the gases flow at an extremely high velocity, and since the time the gases are in contact with water sprays is very short, it is impossible to remove dusts thoroughly from the gases in the chamber.

Furthermore, there is such a problem that the incinerator plant of the above-described structure requires piping facilities for water sprays and treatment of water used for trapping dusts.

In the meantime, the incinerator structure as shown in FIG. 8 has the drawback that ignited waste tires begin burning vigorously in the incinerator, and therefore the door of the incinerator can not be opened.

Therefore, there further exists such a problem that when it has become necessary to incinerate other kinds of wastes, such as plastics, expanded polystyrene, etc. in the course of incineration, the wastes must be charged for incineration into the combustion furnace, and, moreover, incineration of these other kinds of wastes in the combustion furnace will result in incomplete combustion, discharging black smokes out of the plant.

In the meantime, the incinerator structure shown in FIG. 9 has the following problem that since the doors provided in the incinerators and the combustion furnace are directed in three ways, it is very troublesome work to perform the collection of unburned materials and ash remaining in the furnaces after the completion of the burning process.

On the other hand, each of the conventional incinerator structures described above has the following problem that the temperature of a furnace interior reaches 470° to 500° C. during the combustion of waste tires. In conventional structure comprising a bottom plate installed at the bottom and a fan chamber formed under the bottom plate, outside air is drawn into the fan chamber and blasted out upward in the incinerator to promote the combustion of the waste tires because of the efficient combustion of the waste tires. However, this results in red-hot bottom plates, which are formed of iron. Therefore, these bottom plates will be oxidized with repeated use, and corrosion (dry corrosion) of the bottom plates will proceed.

Furthermore, there is also such a problem that, in the duct installed through the passageway connecting the incinerators with the combustion furnace, the open forward end is merely positioned at the center of the passageway, and there exists only little force of air necessary for sending gases produced; therefore, it is impossible to efficiently send the gases out into the combustion furnace for combustion therein.

In view of the above-described problems, the present invention provides the structure of an incinerator which is capable of minimizing the volume of black smoke gases to be discharged therefrom improving convenience of use, and protecting the incinerator from combustion heat.

SUMMARY OF THE INVENTION

The present invention has been accomplished in an attempt to solve the problems mentioned above, and has as its object the provision of a structure of an incinerator plant in which a bottom plate and a partition wall plate are installed at the bottom of an incinerator for incinerating wastes, thereby forming a cooling chamber filled with a cooling water between the bottom plate and the partition wall plate. A combustion furnace formed on the bottom plate and a fan chamber formed under the partition wall plate are connected by a draft tube which is installed through the bottom plate and the partition wall plate, so that the outside air that has been supplied into the fan chamber will flow into the combustion chamber through the draft tube; and the bottom plate which is exposed to combustion heat will be cooled water in the cooling chamber.

The present invention has solved the above-mentioned problems by providing a structure of an incinerator in which the incinerator for incinerating wastes and a combustion furnace for burning gases produced in the incinerator are connected through a passageway, and a gas burning section so designed as to burn gases from the combustion furnace is provided above the combustion furnace.

Furthermore, the present invention has solved the above-mentioned problems by providing a structure of an incinerator plant which includes a combustion furnace interposed for burning gases produced in primary and secondary incinerators between the incinerators, said primary incinerator having an openable waste charging port at its top and so constituted as to incinerate charged wastes therein, and the secondary incinerator having an openable waste charging port at its top and so constituted as to incinerate the charged wastes. The primary incinerator is connected to the combustion furnace by a first passageway and the secondary incinerator is connected to the combustion furnace by a second passageway in a position off the extension line of the first passageway; and furthermore openable doors are arranged in a row on each side in one direction intersecting at right angles with the direction of arrangement of the combustion furnace and the primary and secondary incinerators.

Furthermore, the present invention has solved the above-mentioned problems by providing a structure of an incinerator plant which is provided with a nozzle having a plurality of injection ports at one end of a passageway on the incinerator side, for injecting the outside air from the nozzle to the combustion furnace, thereby sending the gases produced from the incinerator into the combustion furnace.

And furthermore, the present invention has solved the above-mentioned problems by providing a structure of an incinerator plant in which the interior of the combustion furnace into which the gases produced in the incinerator flows has been formed in a cylindrical shape.

The structure of the incinerator plant according to the present invention functions to incinerate wastes such as waste tires in the incinerator, functions to completely burn, in the combustion furnace, gases generated in the incineration process and to incinerate other kinds of wastes during the use of the incinerator, and further functions to thoroughly burn, in the combustion section, the gases produced in the combustion furnace.

Particularly the provision of the gas combustion section enables the complete combustion, in the gas combustion furnace, of gases such as black smokes generated in the course of waste incineration in the combustion furnace, and accordingly allows the burning of wastes in the combustion furnace while incinerating the wastes in the incinerator, thereby enabling effective utilization of incinerating facilities.

The two passageways connecting the two incinerators for incinerating wastes with the combustion furnace for burning gases generated in the incineration process in these two incinerators are installed at different levels, insuring satisfactory injection of flames (burning flames) into the combustion furnace if there exists a difference in a flame injection pressure for the injection of the flames from the incinerators into the combustion furnace.

The combustion furnace and the two incinerators are designed to be arranged in series, and the doors provided in furnaces through which residues are removed are arranged in one line. It is, therefore, possible to collect and remove unburned substances and ash remaining after the completion of the incineration process while these residues are moving straightforwardly, thereby insuring improved operation efficiency and reduced labor.

Meanwhile, in the structure of the incinerator plant according to the present invention, the interior of the incinerator for incinerating wastes is comprised of three stages: a combustion chamber, a cooling chamber and a fan chamber. The fan chamber located at the bottom stage functions to blow the outside air up into the combustion chamber for burning the wastes to promote the combustion of the wastes in the combustion chamber. The cooling chamber interposed between the combustion chamber and the fan chamber functions to cool and protect with cooling water the bottom plate which is the bottom of the combustion chamber.

Furthermore, the nozzle disposed at one end of the passageway on the incinerator side functions to efficiently bring gases generated in the incinerator into the combustion furnace.

This is to say, the outside air is injected as a jet by the nozzle from one end of the passageway on the incinerator side toward the combustion furnace, effectively bringing gases out from the inside of the incinerator into the combustion furnace.

The nozzle has a plurality of injection holes, by which the jet is sprayed in a wide range; therefore, it is impossible to send out a large quantity of gases, improving the combustion efficiency of wastes in the incinerator.

Flames, or the gases ignited, which have been sent out within the combustion furnace, are jetted out with force into the combustion furnace, hitting on an opposite wall surface. The interior of the combustion furnace is cylindrical, forming a vortex (see FIG. 2).

Therefore, the dwell time of the wastes in the combustion furnace increases to burn the gases thoroughly.

DESCRIPTION OF PREFERRED EMBODIMENT

Figure 1:
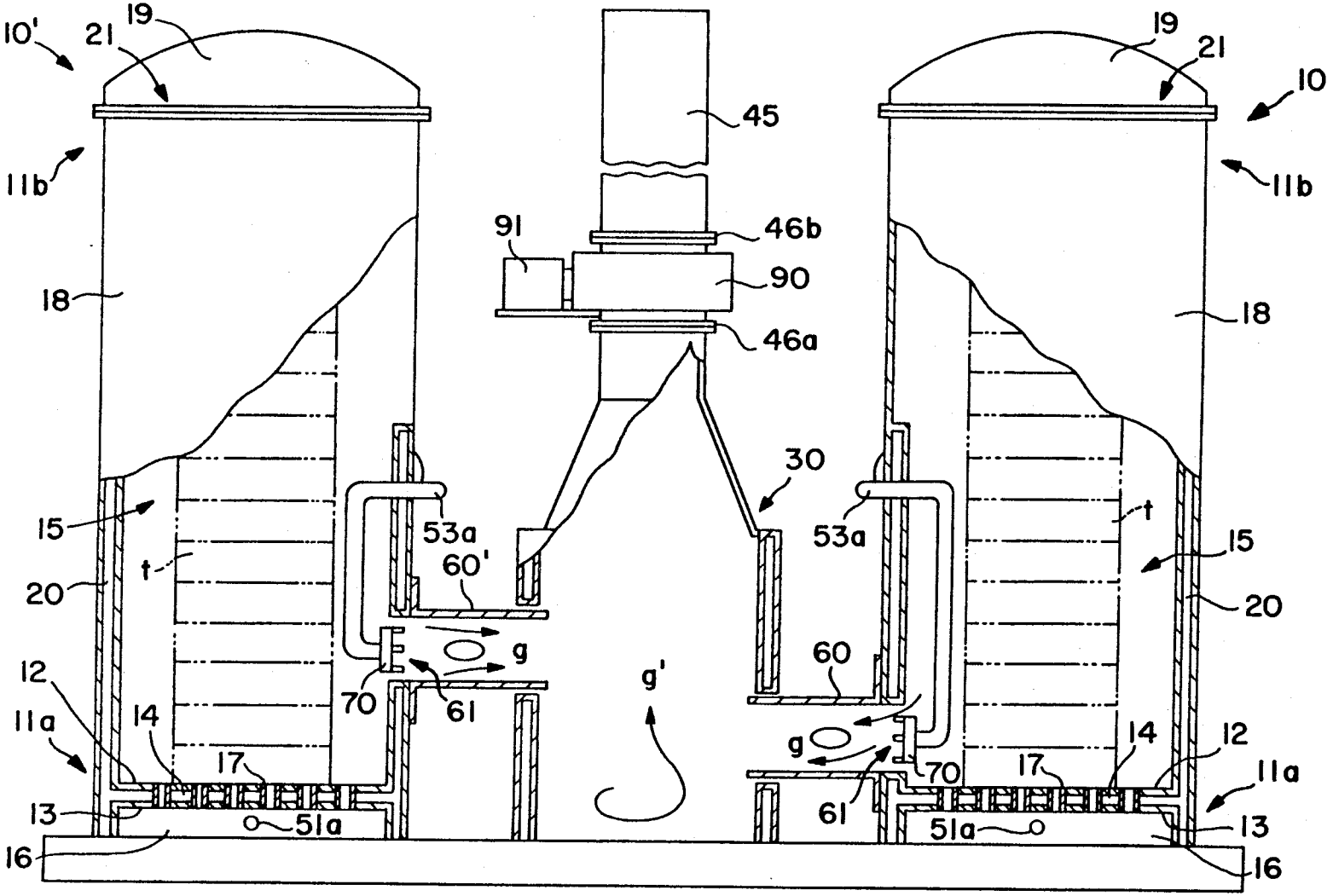
FIG. 1 is a front view partially cut away showing the internal construction of a preferred embodiment of a structure of an incinerator plant according to the present invention.

Hereinafter a preferred embodiment of a structure of an incinerator plant according to the present invention will be described in detail with reference to the accompanying drawings.

In the present embodiment the wastes t are specified as waste tires, but should not be limited thereto in the present invention.

The structure of the incinerator plant according to the present invention comprises a bottom plate 12 and a partition wall plate 13 arranged at a bottom section 11*a* of incinerators 10 and 10' for incinerating the wastes t, to form a cooling chamber 14 filled with cooling water between the bottom plate 12 and the partition wall plate 13, a combustion chamber 15 formed above the bottom plate 12 and a fan chamber 16 formed under the partition wall plate 13 are connected by draft tubes 17, 17, . . . which are installed through the bottom plate 12 and the partition wall plate 13, so that the outside air sent in from the fan chamber 16 will flow into the combustion chamber 15 through the draft tubes 17, 17. Further, the bottom plate 12 heated in the incineration process will be cooled with the cooling water in the cooling chamber 14.

The present invention is characterized in that the incinerators 10 and 10' and the combustion furnace 30 for burning gases g generated in the incinerators 10 and 10' are connected through passageways 60 and 60', and a gas combustion section 90 so constituted as to burn the gases g' from the combustion furnace 30 is provided above the combustion furnace 30.

The present invention further comprises a combustion furnace 30 for burning the gases g generated in the primary and secondary incinerators 10 and 10'. Furnace 30 is disposed between the primary incinerator 10 having an openable wastes charging port at the top and so constituted as to incinerator the wastes t therein and the secondary incinerator 10' having openable waste charging port 21 at the top 11*b* and so constituted as to incinerate the charged wastes t therein. The primary incinerator 10 is connected with the combustion furnace 30 by the first passageway 60. The secondary incinerator 10' is connected with the combustion furnace 30 by a second passageway 60 in a position off the extension line of the first passageway 60. Further openable doors W1, W2 and W3 are arranged in a row on sides R1, R2 and R3 in one direction y intersecting at right angles with the direction x in which the combustion furnace 30 and the primary and secondary incinerators 10 and 10' are disposed.

The present invention is further characterized in that nozzles 70 each having a plurality of injection ports 73*a*, 73*a* are installed at one end 61, 61 of the passageways 60 and 60' on the incinerators 10 and 10' side. The outside air is injected from the nozzles 70 towards the combustion furnace 30, thereby bringing the gases g out into the combustion furnace 30.

Furthermore, the present invention is characterized IN that the combustion furnace 30 into which the gases g generated in the incinerators 10 and 10' flow has a cylindrical interior.

Either of the incinerators 10 and 10' has the wastes charging port 21 which is open for charging wastes t at the tope 11*b*, and comprises a cylindrical body 18 having the cooling chamber 20 formed in the surrounding wall and filled with cooling water and a top cover 19 for hermetically closing the wastes charging port 21.

At the bottom section 11*a* of the body 18 is installed a disk-like bottom plate 12, and under the bottom plate 12 is installed a similar disk-like partition wall plate 13, thus forming the cooling chamber 14 communicating with the aforementioned water cooling chamber 14 between the bottom plate 12 and the partition wall plate 13 and further forming the combustion chamber 15 above the bottom plate 12 and the fan chamber 16 under the partition wall plate 13.

Installed through the bottom plate 12 and the partition wall plate 13 are the draft tubes 17, 17 by which the combustion chamber 15 and the fan chamber 16 are connected.

Figure 2:
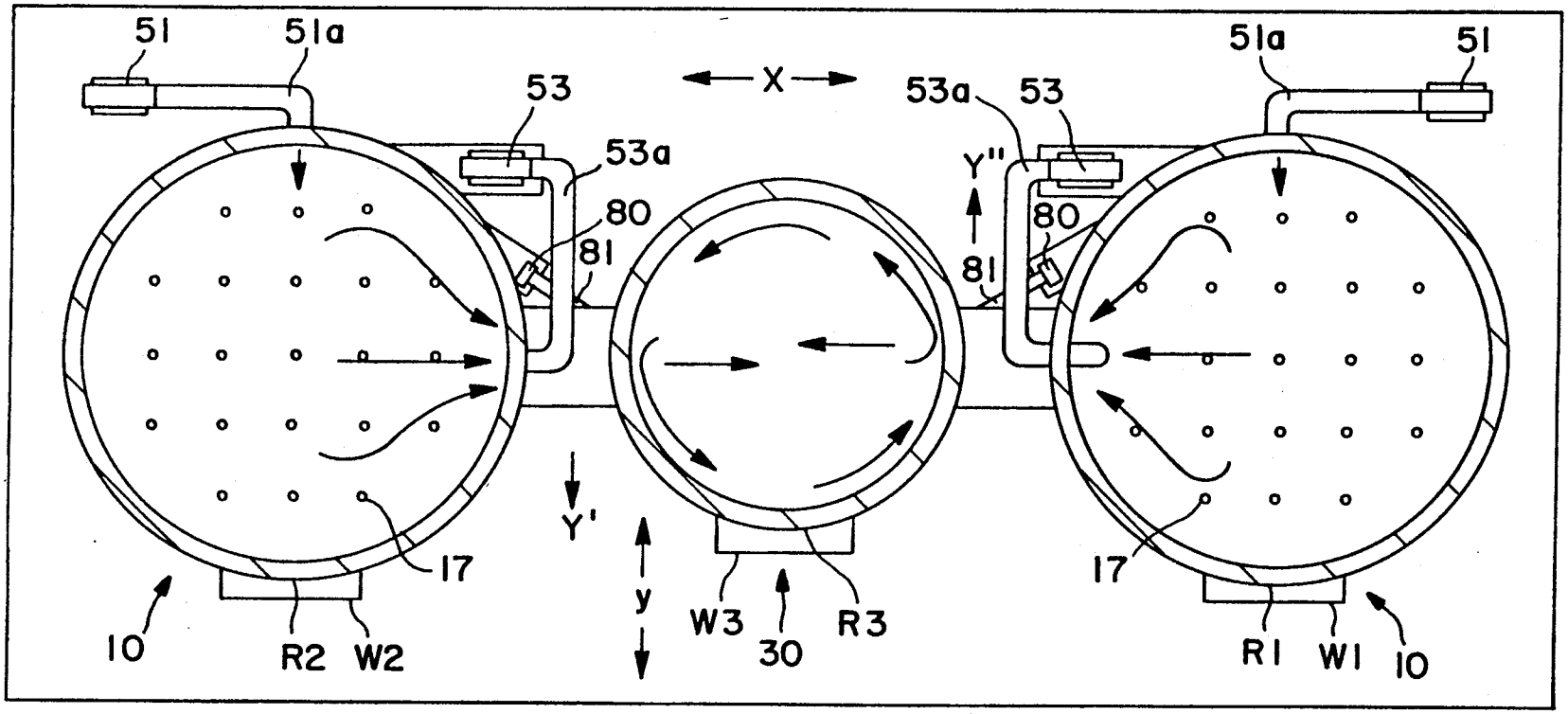
FIG. 2 is a plan view showing an internal construction of the structure of the incinerator plant according to the present invention.

Also in the fan chamber 16 is installed a duct 51*a* of the fan 51 shown in FIG. 2 to flow the outside air into the fan chamber 16.

Figure 3:
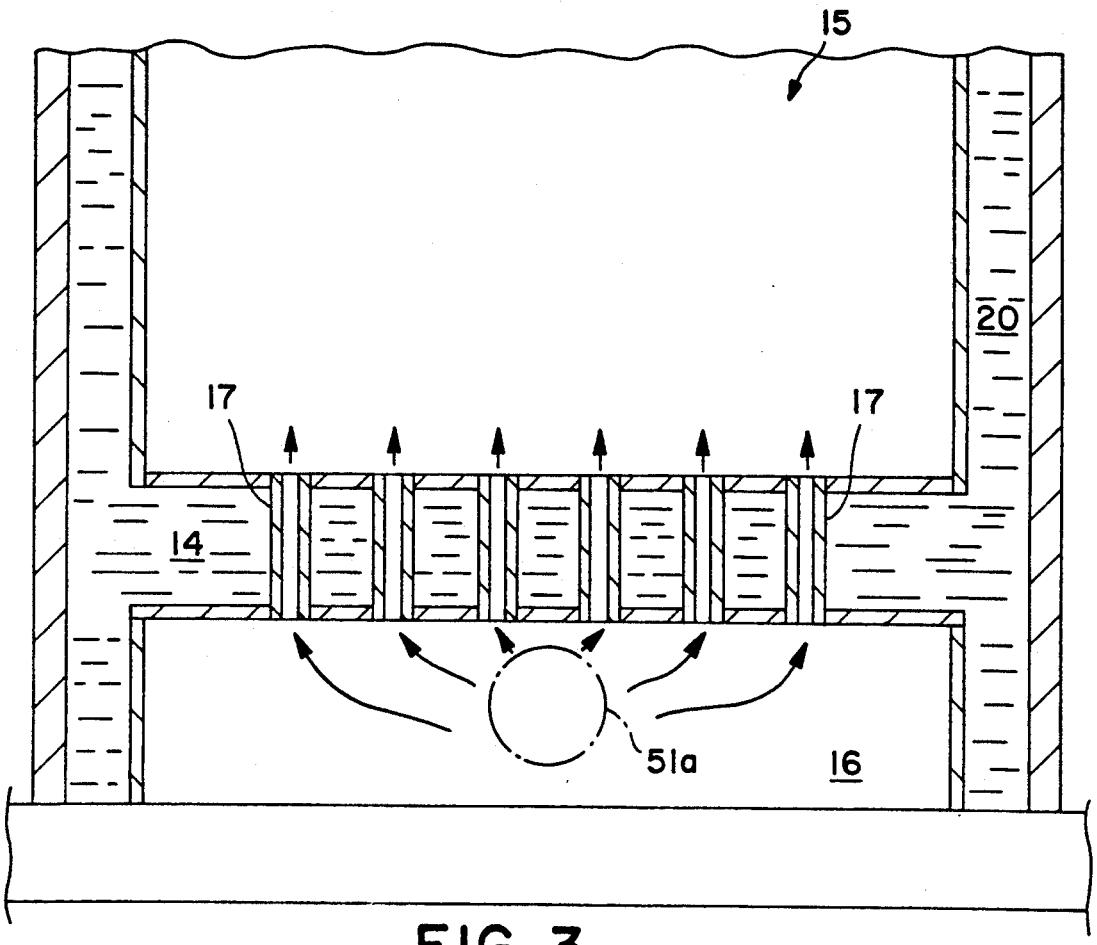
FIG. 3 is an enlarged sectional view showing the bottom section of the incinerator in the structure of the incinerator plant according to the present invention.
Figure 4:
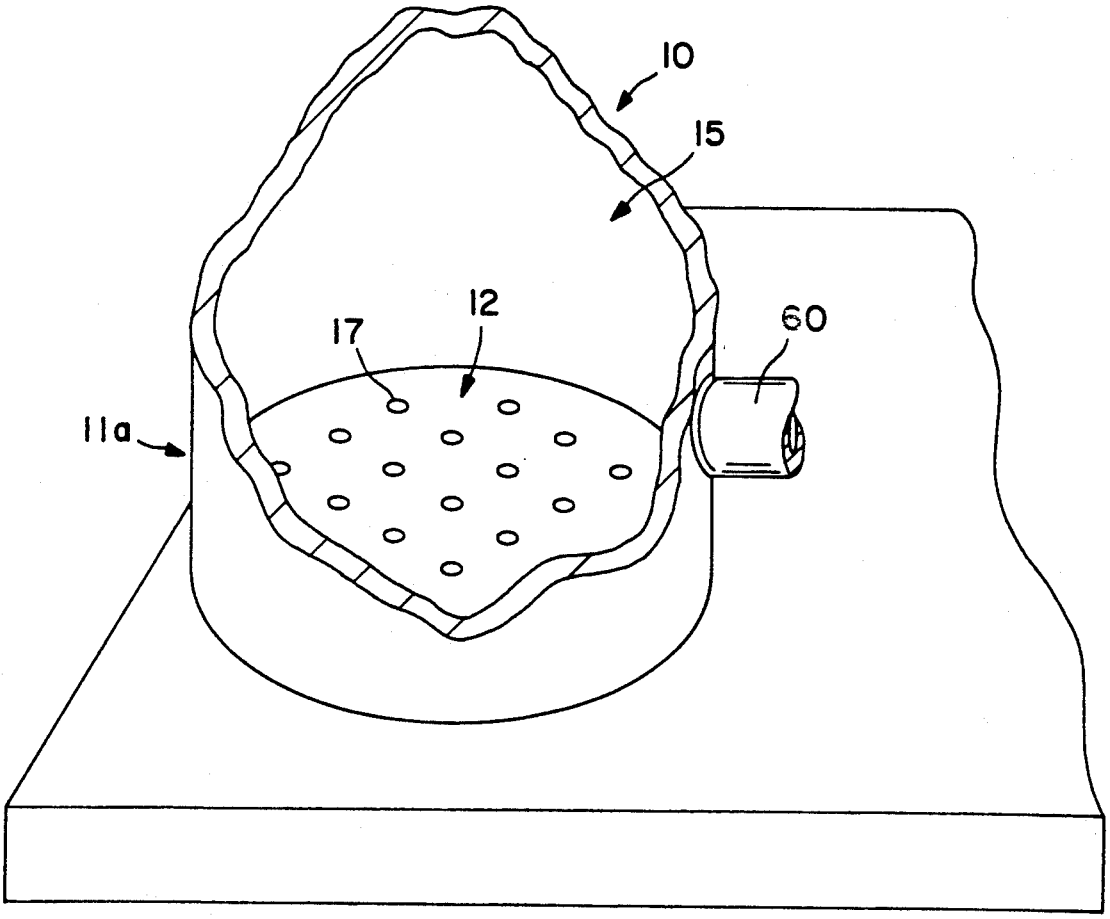
FIG. 4 is a perspective view showing in cut away section the internal construction of the bottom section of the incinerator in the incinerator plant according to the present invention.

Therefore, in the incineration of wastes t charged in the combustion chamber 15, the outside air supplied from the fan chamber 16 flows into the combustion chamber 15 through the draft tubes 17, 17, . . . as shown in FIG. 3, thence promoting the combustion of the wastes t.

The incinerators 10 and 10' are connected to and communicate with the combustion furnace 30 located between the incinerators 10 and 10' through the passageways 60 and 60' which are of a non-linear type.

That is, the incineration of the wastes t is performed in the incinerators 10 and 10', and the gases g generated in the incinerating process are sent into the combustion furnace 30, where the gases g are burned completely, thereby preventing the discharge of a large quantity of dusts contained in the gases g from the stack 45 provided in the upper part of the combustion furnace 30.

The gases g are black smoke produced because of incomplete combustion of the wastes t and contain large quantities of dusts.

The gases g generated in the incinerators 10 and 10' are fed into the combustion furnace 30 by means of the nozzles 70, 70 disposed at one ends 61, 61 of the passageways 60 and 60' on the incinerators 10 and 10' sides.

Figure 5:
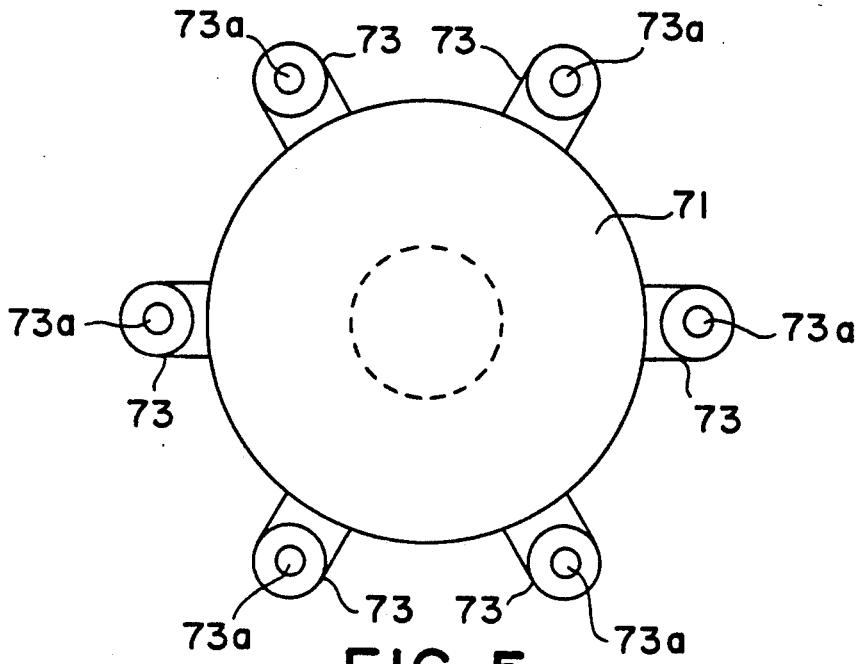
FIG. 5 is a front view showing a nozzle in the structure of the incinerator plant according to the present invention.

The nozzle 70 is composed of a body section 71 which is a hollow, cylindrical body as shown in FIG. 5, and branch pipes 73, 73, . . . radially extending in six directions from the body section 71, and is connected to a fan 53 shown in FIG. 2 through a duct 53*a*, such that the outside air will be injected out toward the combustion furnace 30 from the injection ports 73*a*, 73*a*, . . . opening at the forward end of the branch pipes 73, 73, . . .

Therefore, the gases g generated in the incinerators 10 and 10' are brought into the combustion furnace 30 through the passageways 60 and 60' by utilizing the outside air injected from the nozzle 70.

The gases g thus sent out toward the combustion furnace 30 are ignited with flames injected from a burner 80 through a pipe 81 which is installed obliquely from the rear nearly at the center of the passageways 60 and 60' as shown in FIG. 2.

In the meantime, the gases g thus ignited are forcibly injected as flames into the combustion furnace 30 through the passageways 60 and 60', hitting against the opposite wall surface in the combustion furnace 30. Since the interior of the combustion furnace has a cylindrical shape as shown in FIG. 2, a vortex of the flames is formed therein.

Therefore, the gases g remain for some time inside the combustion furnace 30, where the gases g are burned thoroughly, then being discharged out at the stack 45.

The passageways 60 and 60' are exposed at one end in the lower part of the combustion furnace 30 and at the other end in the upper part of the combustion furnace 30 as previously stated. That is, the passageways 60 and 60' are arranged at different levels, and therefore flames (burning gases g) injected from the incinerators 10 and 10' produce a vortex without colliding within the combustion furnace 30.

Providing the passageways 60 and 60' in the directions of the arrows Y' and Y" in FIG. 2 can further improve vortex formation.

In the meantime the combustion furnace 30 forms a cylindrical combustion chamber inside produced of refractory materials, and has both functions to burn the combustion gases g generated in the incinerators 10 and 10" and also to incinerate other kinds of wastes.

Namely, after the starting of the incineration of wastes in the incinerators 10 and 10', the doors W1 and S2 can not be opened for safety. When the incineration of other kinds of wastes has become of necessity in the course of incineration of the wastes t, it is possible to charge for incineration the other kinds of wastes into the combustion furnace 30 by opening the door W3 provided in the combustion furnace 30.

In the stack 45 erected on the combustion furnace 30 is installed the gas combustion section 90 as previously stated, which is so constituted as to burn the gases g' produced in the course of incineration of expanded polystyrene or the other material in the combustion furnace 30.

Figure 6:
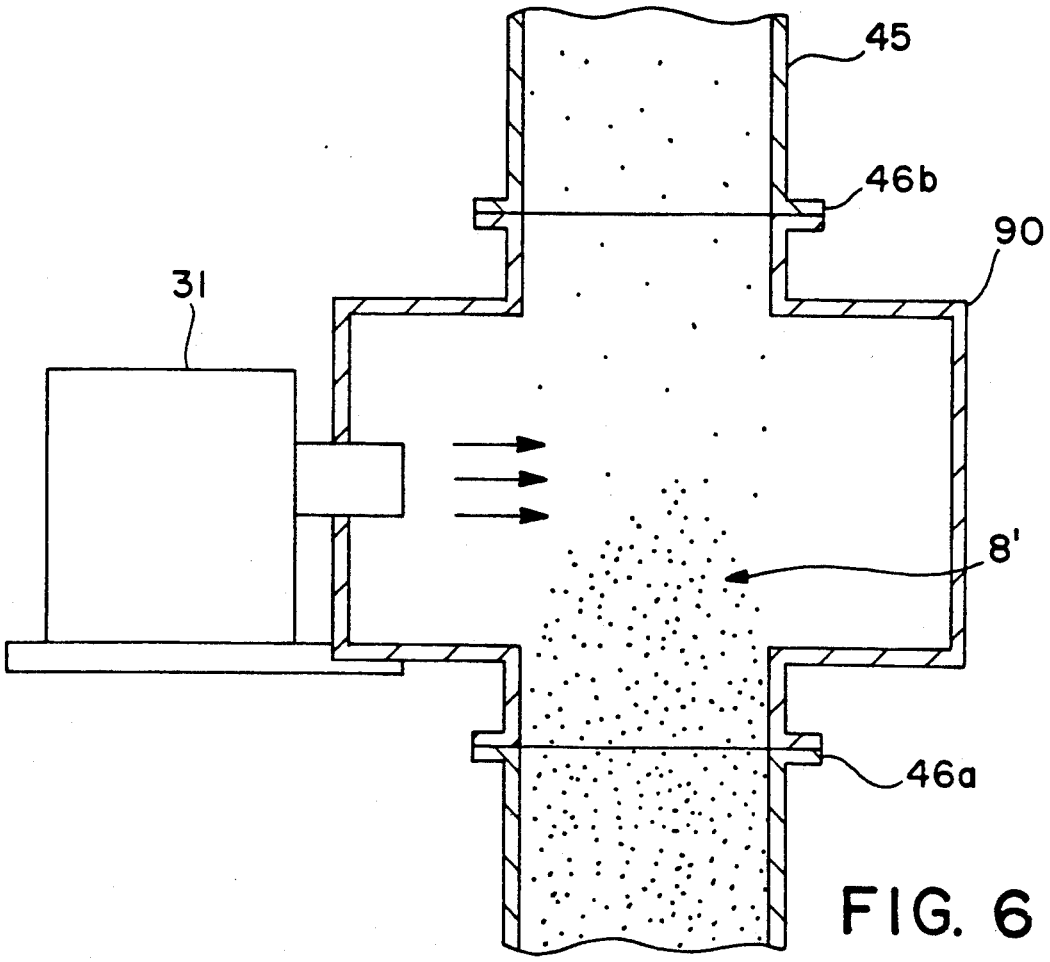
FIG. 6 is an enlarged sectional view showing a gas combustion section in the incinerator plant according to the present invention.
Figure 7:
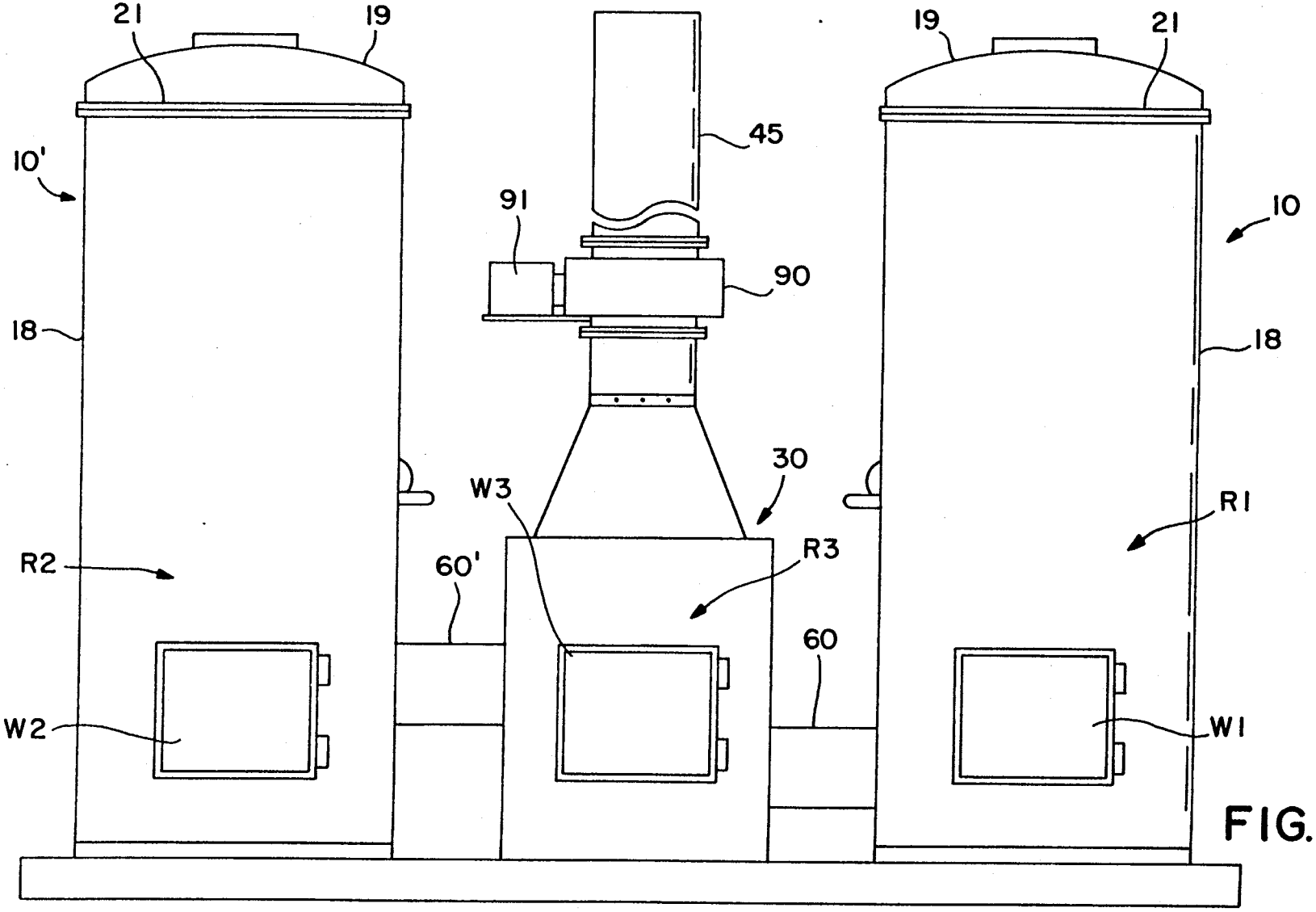
FIG. 7 is a front view showing the structure of the incinerator plant according to the present invention.
Figure 8:
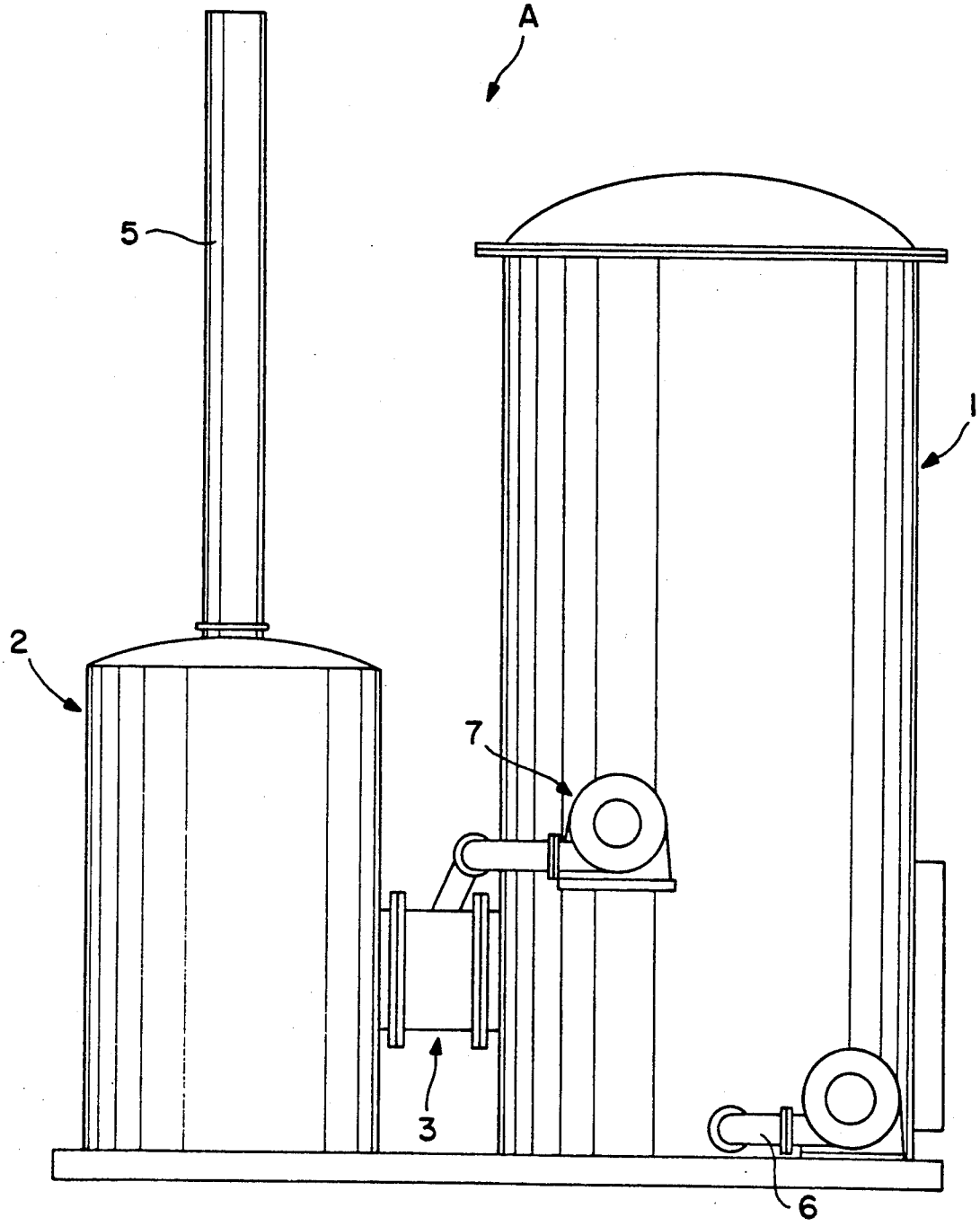
FIG. 8 PRIOR ART
FIG. 8 is a front view of a conventional incinerator plant having a cylindrical incinerator connected to a cylindrical combustion furnace.
Figure 9:
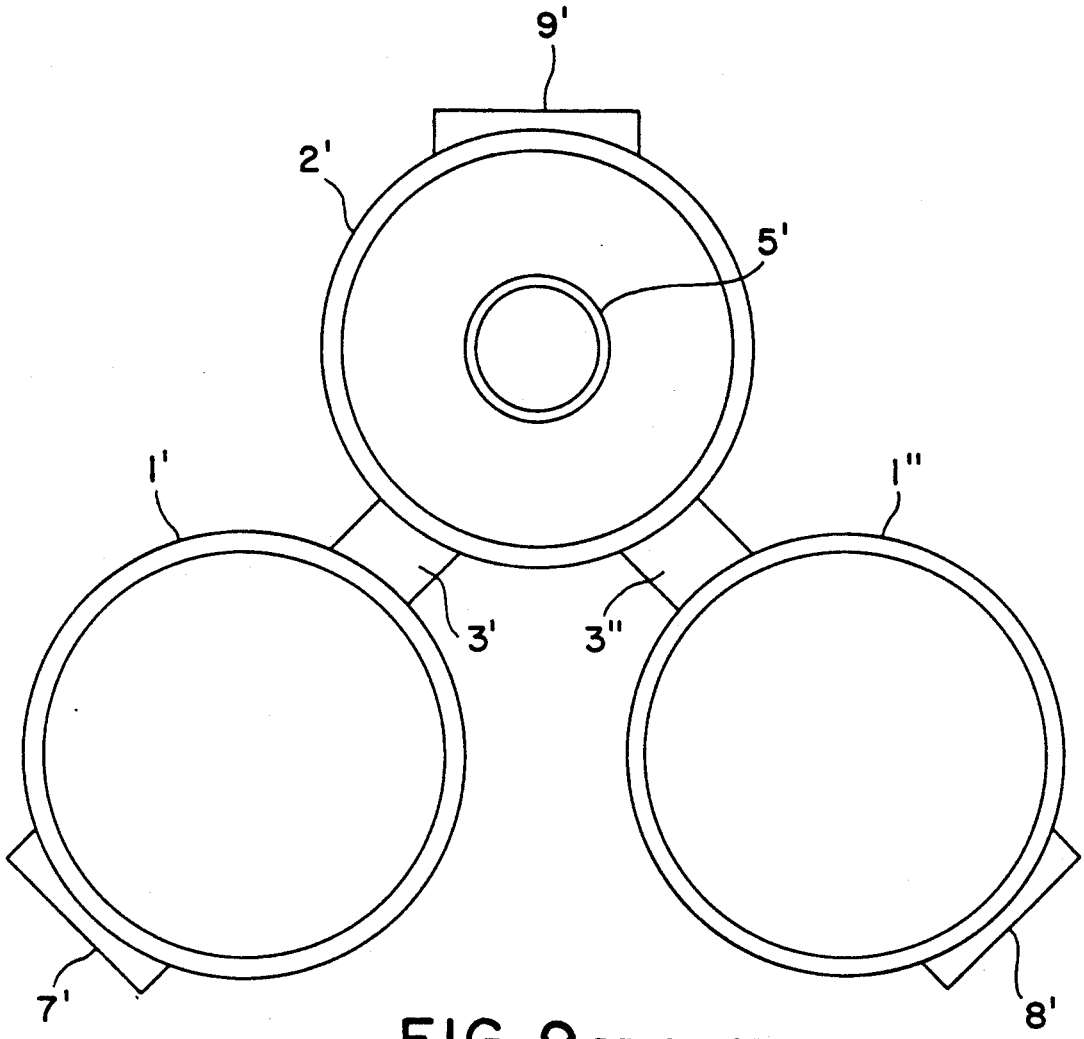
FIG. 9 PRIOR ART
FIG. 9 is a plan view of a conventional incinerator plant having two incinerators connected to one combustion furnace.

The gas combustion section 90 is nearly of a box-like configuration as shown in FIG. 1 and FIG. 6, and is disposed between the upper and lower parts of the stack 45 which are connected by flange joints 46*a* and 46*b*. Into this gas combustion section 90 are injected flames from a burner 91 mounted nearby.

Thus the gases g' are burned in the gas burning section 90, thus removing dusts included in the gases g'. Therefore, if a waste material such as expanded polystyrene is burned in the combustion furnace 30, the gases g' such as black smokes inclusive of dusts will never be discharged out from the stack 45.

Since the openable doors W1, W2 and W3 arranged in a row as previously stated are provided on each of the sides R1, R2 and R3 of the incinerators 10 and 10' and the combustion furnace 30, the collection of unburned matters such as steel wires and ash remaining after the incineration of the wastes t can be performed easily and efficiently.

Next, the method and state of use of the structure of the incinerator plant according to the present invention will be described.

First, with the top covers 19 of the incinerators 10 and 10' removed by the use of a crane truck or other means which is not illustrated, the wastes t are charged from the wastes charging port 21, and then the top covers 19 are installed tight again to close the incinerators 10 and 10'.

After the completion of supply of the wastes t into the incinerators 10 and 10', the wastes t is ignited and at the same time the fan 51 is started to initiate the incinerating process.

In the meantime, when the fan 53 is started, the gases g generated in the incinerators 10 and 10' are sent out together with the outside air into the combustion furnace 30, and, at the same time, are ignited by means of the burner 80.

Measurements were made at each point shown in Tables 2 and 3 of the amount of nitrogen oxides of waste gases discharged out at the stack 45, obtaining the results given in Tables 2 to 5.

When there has arisen a necessity of burning expanded polystyrene or waste paper, it is sufficient to open the door W3 provided in the combustion furnace 30 and charge the waste matter into the combustion furnace 30.

Then when the gases g' such a black smoke have begun to go out at the top of the stack 45, flames are injected from the burner 91 into the gas combustion section 90, where the gases g' will be burned, thereby enabling complete combustion of the gases g' for the purpose of controlling the discharge of dust out of the stack 45.

It should be noted that the present invention is not limited to the above-described structure but may be constituted as described below.

That is to say, the gas combustion section 90 is provided in the upper part of the combustion furnace 30, for igniting the gases g' rising of themselves in the stack 45. It is, however, possible to constitute the incinerator plant so that the gases g' will be sent out to the side of the combustion furnace 30 by the use of the fan as the gases g are sent out into the combustion furnace 30 from the incinerators 10 and 10' by the use of the fan 53; in this combustion furnace 30 the gases g' will be ignited.

EFFECT OF THE INVENTION

The structure of the incinerator plan according to the present invention is of the above-described structure, and has the following advantages.

(1) The structure of the incinerator plant according to the present invention has such excellent advantage that the gas combustion section located in the upper part of the combustion furnace can completely burn combustion gases generated in the combustion furnace, thereby enabling the incineration of wastes in the combustion furnace and the effective use of the incineration facilities and, accordingly, contributing toward the prevention of environmental pollution.

(2) Furthermore, the structure of the incinerator plant according to the present invention has such an excellent advantage that the two incinerators for incineration of wastes are connected to, and communicate with, the combustion furnace for burning the gases generated in the incinerators by two passageways which are disposed at different levels; therefore, flame injection into the combustion furnace can be accomplished satisfactorily through these two passageways even if there has taken place a change in the injection pressure of flames being injected from the incinerators into the combustion furnace.

(3) Furthermore, the structure of the incinerator plant has such an excellent advantage that since the doors provided for removal of residues in the two incinerators and the combustion furnace are arranged on one line, unburned matters and ash remaining after the incinerating process can be collected and removed while moving straightforward and, accordingly, it is possible to accomplish the operation with ease and efficiently.

(4) Furthermore, the structure of the incinerator plant has such an excellent advantage that the interior of the incinerators for incinerating wastes is of a three-stage structure comprising a combustion chamber, a cooling chamber and a fan chamber from above; the fan chamber located in the lower stage works to blow the outside air into the combustion furnace for burning the wastes in order to promote the combustion of the wastes in the combustion chamber, and also the cooling chamber located between the combustion chamber and the fan chamber functions to cool and protect the bottom plate which forms the bottom of the combustion chamber.

(5) Furthermore, the structure of the incinerator plant has such an excellent advantage that the outside air is injected by the nozzle from one end of the passageway on the incinerator side toward the combustion furnace; particularly the jet is spread wide by the use of a plurality of injection ports of the nozzle, and therefore a large quantity of gases can be brought into the combustion furnace, improving the combustion efficiency of wastes in the incinerators.

(6) Furthermore, the structure of the incinerator plant has such an excellent advantage that the interior of the combustion furnace is cylindrical, and therefore the combustion gases sent out into the combustion furnace remain in the form of a vortex for some time and are completely burned in the combustion furnace; it is therefore possible to minimize the quantity of dusts included in the gases which will be discharged out of the plant.

While preferred embodiments of the present invention are shown and described hereinabove, it will be understood that the invention is not to be limited thereto, since many modifications and changes may be made therein, and it is contemplated therefore, by the appended claims, to cover any such modifications as fall within the true spirit and scope of the present invention.

What is claimed is:

1. An incinerator plant comprising a combustion furnace disposed between a primary incinerator having an openable waste charging port at its top and adapted to burn charged wastes therein, and a secondary incinerator adapted to burn charged wastes therein, said combustion furnace adapted to burn combustion gases generated in said primary and secondary incinerators, said primary incinerator being connected to said combustion furnace through a first passageway, and said secondary incinerator being connected to said combustion furnace through a second passageway in a position off an extension line of said first passageway, and openable doors on said primary and secondary incinerators and combustion furnace, said doors arranged in a row on the same side, and in one direction intersecting at right angles with a direction in which said combustion furnace and said primary and secondary incinerators are arranged.

2. An incinerator plant comprising a passageway connecting an incinerator for burning wastes to a combustion furnace for burning combustion gases produced in said incinerator, said incinerator plant having a gas combustion section to burn gases discharged from said combustion furnace, said gas combustion section being mounted above said combustion furnace, wherein an nozzle having a plurality of injection ports is disposed at one end of a passageway on said incinerator side, for injection of outside air from said nozzle thereby sending gases produced from said incinerator into said combustion furnace.

3. The incinerator plant of claim 2, wherein the interior of said combustion furnace into which gases produced in said incinerator flow is cylindrical.

4. The incinerator plant of claim 1, wherein a nozzle having a plurality of injection ports is disposed at one end of a passageway on said incinerator side, for injection of outside air from said nozzle toward said combustion furnace, thereby sending gases produced from said incinerator into said combustion furnace.

* * * * *